US010028629B2

(12) United States Patent
Ryu et al.

(10) Patent No.: US 10,028,629 B2
(45) Date of Patent: Jul. 24, 2018

(54) WINDOW CLEANING APPARATUS AND METHOD OF CONTROLLING THE SAME

(71) Applicant: RF Co., Ltd., Daegu (JP)

(72) Inventors: Man-Hyun Ryu, Seongnam-si (KR); Dong-Kyu Kim, Gyeongsan-si (KR)

(73) Assignee: RF Co., Ltd., Daegu (KR)

( * ) Notice: Subject to any disclaimer, the term of this patent is extended or adjusted under 35 U.S.C. 154(b) by 0 days.

(21) Appl. No.: 14/777,699

(22) PCT Filed: Mar. 29, 2013

(86) PCT No.: PCT/KR2013/002642
§ 371 (c)(1),
(2) Date: Sep. 16, 2015

(87) PCT Pub. No.: WO2014/157759
PCT Pub. Date: Oct. 2, 2014

(65) Prior Publication Data

US 2016/0081520 A1 Mar. 24, 2016

(51) Int. Cl.
*A47L 1/03* (2006.01)

(52) U.S. Cl.
CPC ..... *A47L 1/03* (2013.01); *A47L 2201/04* (2013.01)

(58) Field of Classification Search
CPC ..... A47L 1/02; A47L 1/03; A47L 1/05; A47L 1/12; A47L 1/13
See application file for complete search history.

(56) References Cited

U.S. PATENT DOCUMENTS

2011/0308547 A1 12/2011 Chao
2013/0014782 A1 1/2013 Ryu

FOREIGN PATENT DOCUMENTS

KR 10-2005-0061242 A 6/2005
KR 10-2007-0037759 A 4/2007
KR 20-0438170 Y1 1/2008
KR 10-2011-0114370 A 10/2011
KR 10-1241250 B1 3/2013

OTHER PUBLICATIONS

Communication from the European Patent Office dated Nov. 4, 2016 in European Application No. 13880162.6.
International Search Report for PCT/KR2013/002642 dated Dec. 30, 2013 [PCT/ISA/210].
Written Opinion for PCT/KR2013/002642 dated Dec. 30, 2013 [PCT/ISA/237].

*Primary Examiner* — Laura C Guidotti
(74) *Attorney, Agent, or Firm* — Revolution IP, PLLC

(57) ABSTRACT

A window cleaning apparatus according to an embodiment of the present invention includes a first cleaning unit and a second cleaning unit attached on opposite surfaces of a window, respectively, through a magnetic field, and moving on the opposite surfaces of a window. The window cleaning apparatus includes a first magnetic module included in the first cleaning unit, a second magnetic module included in the second cleaning unit, and a control part moving or rotating at least one of the first and second cleaning units when the magnetic field between the first and second cleaning units is out of a normal range.

4 Claims, 10 Drawing Sheets

(b)

WINDOW CLEANING APPARATUS AND METHOD OF CONTROLLING THE SAME

TECHNICAL FIELD

The present invention relates to a window cleaning apparatus.

BACKGROUND ART

In general, a window installed at a wall of a building is easily polluted by external dusts and air pollution to spoil the beauty and to be worse-lighted. Therefore, it is preferable to frequently clean the window installed at a wall of a building.

However, cleaning an outer side of the window is harder in comparison with cleaning an inner side of the window. Especially, as the buildings become Manhattanized, cleaning the outer side of the window becomes more dangerous.

Further, in case of a vehicle glass, cleaning is not easy except a vehicle windscreen with a brush.

DETAILED DESCRIPTION OF THE INVENTION

Objects of the Invention

The object of the present invention is to provide a window cleaning apparatus capable of improve efficiency and stability of operation and a method of controlling the window cleaning apparatus.

Technical Solution

A window cleaning apparatus according to an embodiment of the present invention includes a first cleaning unit and a second cleaning unit attached on opposite surfaces of a window, respectively, through a magnetic field, and moving on the opposite surfaces of a window. The window cleaning apparatus includes a first magnetic module included in the first cleaning unit, a second magnetic module included in the second cleaning unit, and a control part moving or rotating at least one of the first and second cleaning units when the magnetic field between the first and second cleaning units is out of a normal range.

On the other hand, a method of controlling a window cleaning apparatus according to an embodiment of the present invention includes detecting if the magnetic field between the first and second cleaning units is within a normal range, and adjusting a position of at least one of the first and second cleaning units when the magnetic field between the first and second cleaning units is out of the normal range.

On the other hand, the window cleaning apparatus may be embodied as a computer readable storage medium for performing through a computer.

Advantageous Effects

According to the present invention, when a gap between the first and second cleaning units attached opposite surfaces of a window, respectively becomes equal to or greater than a specific value to decrease the magnetic field between the first and second cleaning units, the position of the cleaning unit is adjusted to return the magnetic field in the normal range so that operation performance of the window cleaning apparatus is improved and falling is prevented to improve safety.

EMBODIMENTS OF THE INVENTION

Hereinafter, the present invention is explained referring to figures as follows. The embodiment below may be embodied in many different forms, and this invention is not construed as limited to the embodiments set forth herein. The embodiments are provided for completely explaining the invention to a person ordinary skilled in the art. Therefore, a shape and a size of elements in figures may be exaggerated for clear explaining.

Figure 1:
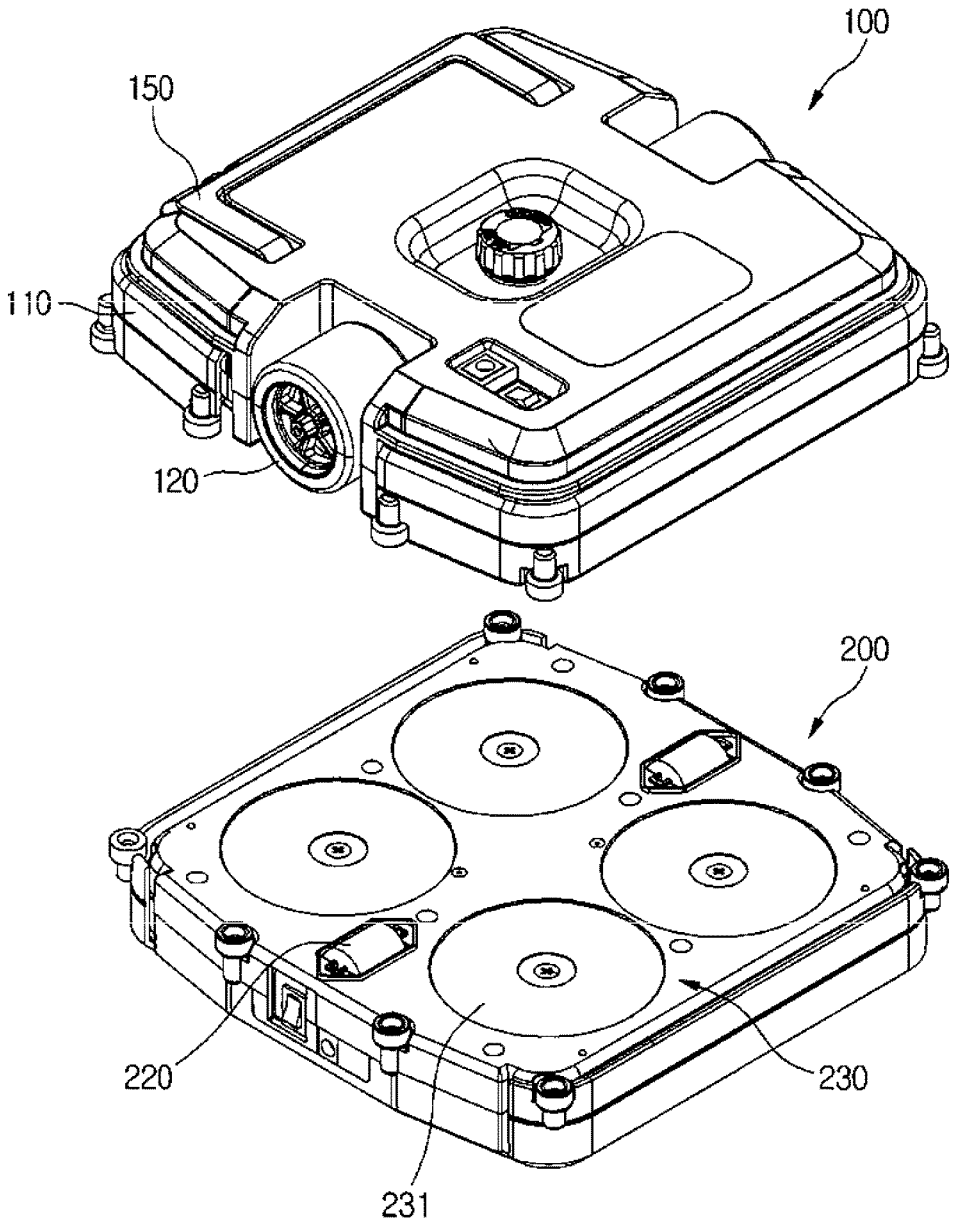
FIG. 1 is a perspective view briefly showing a structure of a window cleaning apparatus according to an embodiment of the present invention.

FIG. 1 is a perspective view briefly showing a structure of a window cleaning apparatus according to an embodiment of the present invention, and the window cleaning apparatus in FIG. 1 includes two cleaning units 100 and 200 respectively disposed at both surfaces of a window.

Referring to FIG. 1, a first cleaning unit 100 may be disposed at an inner surface of the window, and a second cleaning unit 200 may be disposed at an outer surface of the window, and the second cleaning unit 200 moves along the first cleaning module so that window cleaning is performed by the second cleaning unit 200.

The first cleaning unit 100 and the second cleaning unit 200 are attached to each other with the window interposed therebetween by using magnetic modules respectively installed at inside there.

Further, when the first cleaning module 100 moves on the inner surface of the window by an external or built-in power, the second cleaning module 200 can move along the first cleaning module 100 by magnetic force between magnetic modules respectively installed at the first and second cleaning modules 100 and 200.

The first cleaning unit 100 may include an attachment/detachment member 150, for example a handle 150, for attaching the first cleaning unit 100 to a window or for detaching the first cleaning unit 100 from the window, and the second cleaning unit 200 also may include an attachment/detachment member (not shown) installed at an upper part of the second cleaning unit 200.

Therefore, when a user uses the window cleaning apparatus, the user can attach the window cleaning apparatus to a window by using the two attachment/detachment members, that are handles, respectively installed at the first and second cleaning units 100 and 200, and the user can detach the first and second cleaning units 100 and 200 from the window by using the two handles.

On the other hand, the window cleaning apparatus according to the embodiment of the present invention may further include a remote controller (not shown) that allows the user to control operation of the first and second cleaning units 100 and 200.

As described above, the second cleaning unit 200 moves subordinately by magnetic force as the first cleaning unit 100 moves, and a user can control operation of the window cleaning apparatus including the first and second cleaning units 100 and 200 by controlling moving of the first cleaning unit 100 through the remote controller (not shown).

In the present embodiment, the window cleaning apparatus employs a wireless type remote controller (not shown) for a convenience of a user, but the window cleaning apparatus employ a wired type controller or a user can manually operate the window cleaning apparatus.

On the other hand, the window cleaning apparatus according to an embodiment of the present invention, or in more detail, the first cleaning unit 100 disposed on the inner surface of a window may move along a previously set moving path or the window cleaning apparatus may include a sensor (not shown) for sensing dusts, etc. and determine a moving path for improving cleaning efficiency to move along the moving path.

Hereinafter, more detailed structure of the first and second cleaning units 100 and 200 in FIG. 1 will be explained referring to FIG. 2 and FIG. 3.

Figure 2:
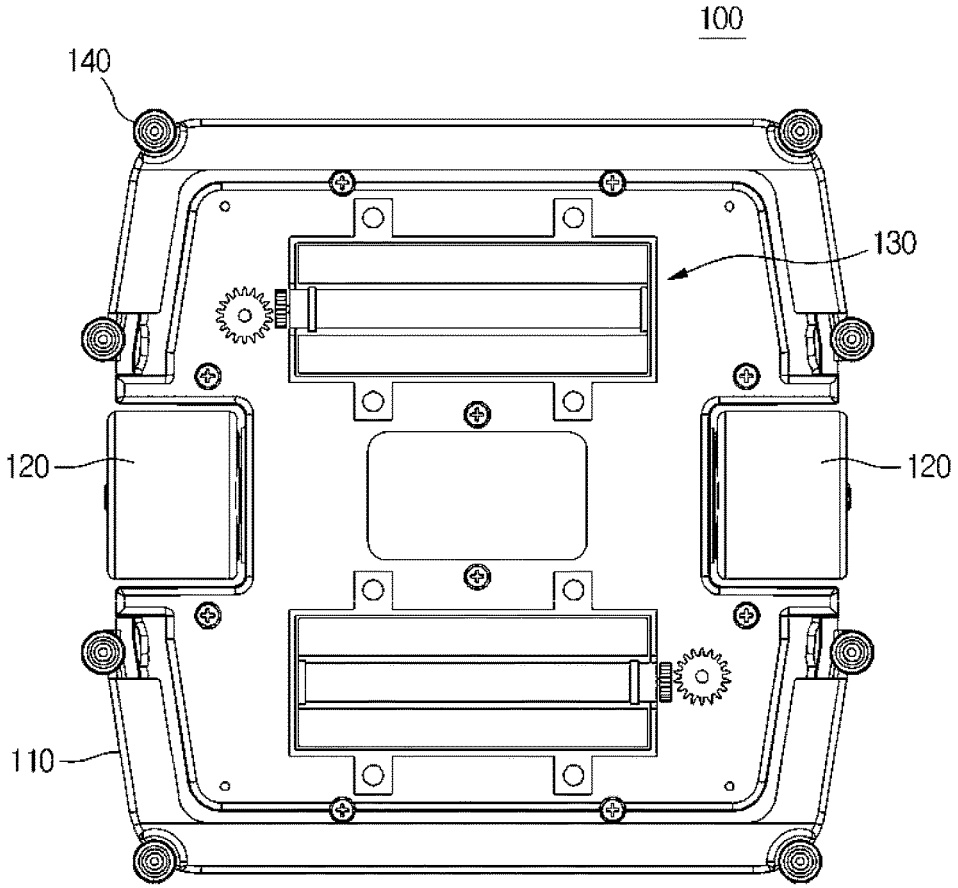
FIG. 2 is a plan view showing a first cleaning unit disposed on an inner surface of a window according to an embodiment of the present invention.

FIG. 2 is a plan view showing a structure of a first cleaning unit 100, and showing an upper face making contact with a window in two faces of the first cleaning unit 100.

Referring to FIG. 2, the first cleaning unit 100 may include a first frame 110, a plurality of first wheel members 120 and a plurality of first magnetic modules 130.

The first frame 110 forms a body of the first cleaning unit 100, and the plurality of first wheel members 120 and the plurality of first magnetic modules 130 may be combined with and fixed to the first frame 110.

On the other hand, a buffer member 140 may be installed at a border of the first frame 110 to minimize impact when the window cleaning apparatus collides with a protrusion such as a window frame while moving. Further, when a sensor (not shown), etc. connected with the buffer member 140 senses impact, the first cleaning unit 100 may change a moving path.

On the other hand, the first cleaning unit 100 may include a plurality of first magnetic modules 130, and the magnetic modules 130 not only generate magnetic force in order that the first cleaning unit 100 and the second cleaning unit 200 are attached to both sides of a window, but also the magnetic force between the first magnetic module 130 and the second magnetic module 233 may be adjusted by rotating a first magnetic force controller of the first magnetic module 130 (refer to FIG. 9A through FIG. 12B and explanation of those). Further detailed explanation regarding to this will be explained referring to FIG. 9A through FIG. 12B.

And, the first magnetic module 130 may include a permanent magnet such as a neodymium magnet and generate magnetic force together with the second magnetic module 233 installed in the second cleaning unit 200.

In more detail, the first magnetic module 130 installed in the first cleaning unit 100 and the second magnetic module 233 installed in the second cleaning unit may have respectively magnets with opposite poles. As a result, the first and second cleaning units 100 and 200 respectively disposed at both sides of a window pull each other to be respectively attached to and to be able to move on the both sides of the window.

Further, as another embodiment, the magnetic modules 130 and 233 may be embodied by electromagnet except permanent magnet, and as still another embodiment, the magnetic modules 130 and 233 may be embodied by both of electromagnet and permanent magnet.

The window cleaning apparatus according to embodiments of the present invention is not limited by the magnetic modules 130 and 233 as described above, but various modifications may be possible as long as the first and second cleaning units 100 and 200 are attached to each other and move with a window interposed therebetween.

For example, one of the first and second cleaning units 100 and 200 may include a magnet and the other may include metal that can be pulled by the magnet.

As described in FIG. 2, the first magnetic module 130 may be formed by a plurality of magnets arranged in a horizontal direction, and two of the first magnetic module 130 may be installed in the first cleaning units 100.

For reference, FIG. 2 is a figure for showing the first magnetic module 130 according to an embodiment of the present invention, the first magnetic module 130 may be covered by a cover, etc. when the first cleaning unit 100 is used in a real case.

One of the magnet constructing the first magnetic module 130 is rotated by a motor, and the magnetic force between the first magnetic module 130 and the second magnetic module 233 is adjusted by the rotating magnet. Regarding to this, more detailed explanation will be presented referring to relating figure.

On the other hand, two or more than two of the first wheel member 120 are installed, for example, at for example left and right sides of the first cleaning unit 100, such that a portion of the first wheel member 120 is exposed over an upper portion of the first frame 110, or four of the first wheel member 120 may be disposed at corners, respectively.

For example, the first wheel member 120 may be rotated by a driving part (not shown) such as a motor installed inside of the first frame 110. The first cleaning unit 100 may move in a pretermitted direction as a first wheel member 120 rotates while attached to a window.

On the other hand, the first cleaning unit 100 can move not only in a straight direction but also in a curved direction. In other word, the first cleaning unit 100 can change the moving direction. For example, the first cleaning unit 100 can change the moving direction by changing a direction of a rotation axis of the first wheel member 120 or rotating the two first wheel members 120 of right and left sides in a different rotation speed.

A surface of the first wheel member 120 may be formed by fabric, rubber, silicone, etc. for generating frictional force against a window so that the first cleaning unit 100 can easily move on the inner surface of a window without no-load rotation of the first wheel member 120. Further, the surface of the first wheel member 120 may be formed by a material not forming scratch on a window when the first wheel member 120 rotates.

The first cleaning unit 100 is attached to a window by the magnetic force of the first magnetic module 130, so that normal force in a vertical direction of the window may be applied to the first wheel member 120. Therefore, when the first wheel member 120 is rotated by the driving part (not shown) including a motor, etc., the first cleaning unit 100 can move on the inner surface of a window by a frictional force.

On the other hand, when the first cleaning unit 100 moves by the first wheel member 120, the second cleaning unit 200 attached to the opposite surface of the window, that is the outer surface of the window, can move as if one body with the first cleaning unit 100 along the first cleaning unit 100 through the magnetic force.

Figure 3:
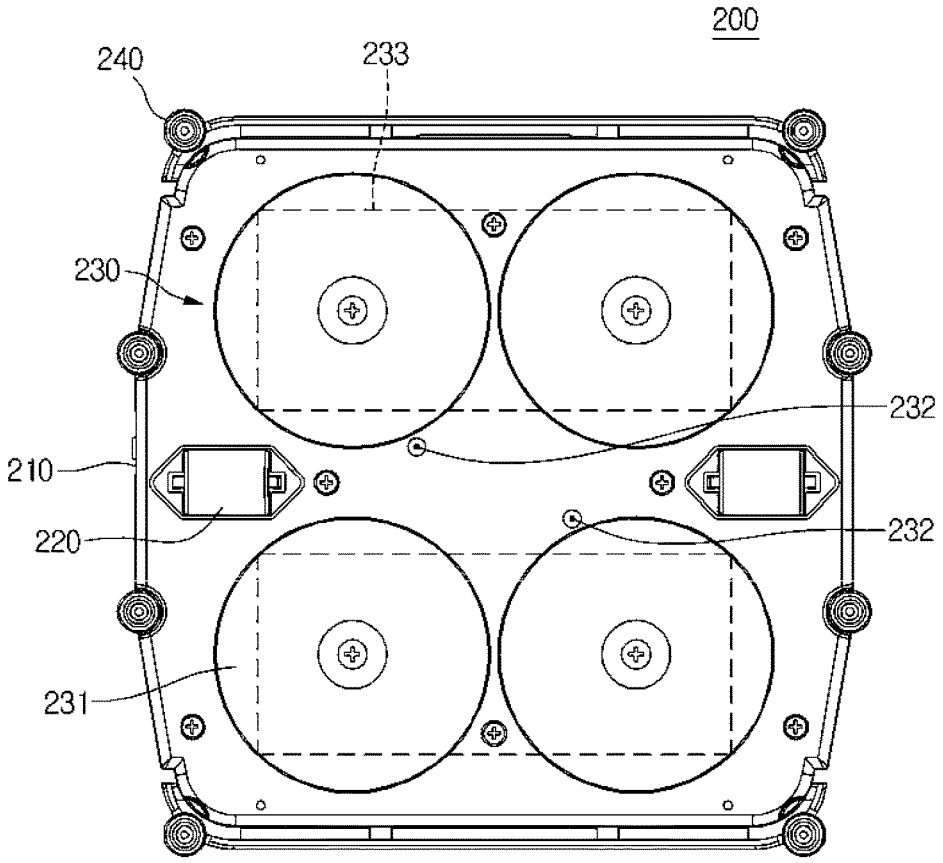
FIG. 3 is a plan view showing a second cleaning unit disposed on an outer surface of a window according to an embodiment of the present invention.

FIG. 3 is a plan view showing a second cleaning unit disposed on an outer surface of a window according to an embodiment of the present invention, FIG. 3 shows a structure of a lower face of the second cleaning unit 200, which makes contact with a window.

Referring to FIG. 3, the second cleaning unit 200 may include a second frame 210, a plurality of second wheel members 220 and a plurality of cleaning modules 230.

The second frame 210 forms a body of the second cleaning unit 200, and may have a shape corresponding to the shape of the first frame 110 of the first cleaning unit 100. For example, the second frame 210 may have a plate structure having a rectangular cross-section.

The plurality of first wheel members 120 is formed at the lower face of the second frame 210, and capable of making the second cleaning unit 200 move along the first cleaning unit 100 by magnetic force.

According to an embodiment of the present invention, the second wheel member 220 is not connected to a driving part such as a motor, unlike the first wheel member 120 installed at the first cleaning unit 100, but the second wheel member 220 is installed at the second frame through an axis in order that the second wheel member 220 can naturally rotate when the second cleaning unit 200 moves.

Therefore, when the second cleaning unit 200 moves with the first cleaning unit 100 through the magnetic force, the second wheel member 220 may rotate to operate as a bearing.

In FIG. 3, the second wheel member 220 is formed to have, for example, a circular cylindrical shape. However, the shape of the second wheel member 220 is not limited to that. For example, the second wheel member 220 may have a globular shape such as a ball bearing.

The cleaning module 230 is formed to be exposed under a lower portion of the second frame 210 to clean a side of a window, for example an outer surface of a window on which the second cleaning unit 200 is disposed.

As shown in FIG. 3, the cleaning module 230 may include a plurality of modules, for example, such as a cleaning pad 231 and a detergent sprayer 232.

On the other hand, each of four disc shapes included in the cleaning module 230 may be formed to be rotatable by a driving part (not shown). Further, the cleaning module 230 may be formed to be protruded from a lower face of the second frame 210 by a specific distance, so that the cleaning module 230 can rotate to perform cleaning of the outer face of the window by frictional force when the second cleaning unit 200 is attached to the outer face of the window.

In order that the cleaning module 230 easily remove dusts by frictional force when rotating, a pad 231 including fabric, rubber, etc. may be attached to exposed face of the cleaning module 230. In this case, in order to improve cleaning performance of the window cleaning apparatus, the pad 231 may be formed by a material of minute fabric or porosity.

Additionally, the cleaning module 230 may include the detergent sprayer 232 for spraying detergent. For example, the detergent sprayer 232 may be connected to a detergent container (not shown) and a pump (not shown) in the second cleaning unit 200 through a flowing path to receive detergent. Therefore, the cleaning module 230 can perform cleaning with spraying detergent to the window by the detergent sprayer 232 when cleaning the window.

On the other hand, the second magnetic module 233 is disposed inside of the cleaning module 230, that is, in the second cleaning unit 200. The second magnetic module 233 may have a shape corresponding to the first magnetic module 130 in the first cleaning unit 100, but the shape of the second magnetic module 233 is not limited to that. The first and second magnetic modules 130 and 233 generate magnetic force in order that the first and second cleaning units 100 and 200 attached to each other with the window disposed therebetween.

The second magnetic module 233 may include magnet such as permanent magnet or electromagnet, or metal. Therefore, the first and second cleaning units 100 and 200 attached at opposite two sides of a window, respectively pull each other so that the first and second cleaning units 100 and 200 are movably attached to the opposite two sides of the window, respectively.

Further, a continuous force is applied to the cleaning module 230 in a direction toward the window by the magnetic force between the first and second magnetic modules 130 and 233 so that frictional force increases to enhance cleaning performance when the cleaning module 230 rotates.

Referring to FIG. 3, the second cleaning unit 200 may further include a plurality of sub cleaning modules 240 formed at corner part of the second cleaning unit 200. The cleaning module 230 is formed at inside of the second frame 210 so that it is very hard to clean the border region of the window. Therefore, the sub cleaning modules 240 of the second cleaning unit can clean the border region such as a window frame of the window.

The sub cleaning module 240 may include a roller member (not shown) that is rotatably installed, and a brush formed at outer circumference surface of the roller member. Therefore, the sub cleaning module 240 can rotate to remove dust of the window frame when the second cleaning unit 200 moves along the window frame.

Additionally, the sub cleaning modules 240 may perform the same function as the buffer member 140 in the first cleaning unit 100. That is, the sub cleaning modules can minimize impact when collided with a protrusion such as a window frame and sense impact.

In the above, the window cleaning apparatus has a structure for cleaning only one surface of a window (that is outer surface of a window) as described referring to FIG. 1 through FIG. 3, but the above is only an embodiment and the present invention is not limited to that.

For example, the first cleaning unit 100 can also include a cleaning module 230 in the second cleaning unit 200, so that the window cleaning apparatus can clean both surface of a window simultaneously.

According to the embodiment of the present invention, the magnetic force between the first and second cleaning units 100 and 200 movably attached to opposite sides of a window, can be sensed and the magnetic force that is sensed can be adjusted to by a previously set value.

Figure 4:
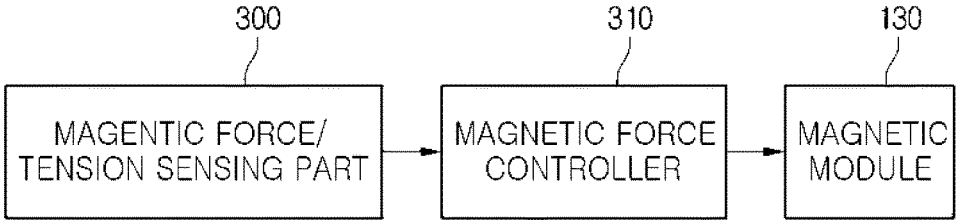
FIG. 4 is a block diagram showing a magnetic force controller installed in the window cleaning apparatus according to an embodiment of the present invention.

Referring to FIG. 4, a magnetic force sensing part 300 senses magnetic force or physical tension between the first and second cleaning units 100 and 200 attached to the window with the window interposed therebetween, and can include a magnetic sensor (not shown) installed at least one of the first and second cleaning units 100 and 200, which can sense the magnetic force and the physical tension.

The magnetic force between the first and second cleaning units 100 and 200 is a force attaching the first and second cleaning units 100 and 200 with a window interposed therebetween, and may be a magnetic force between the first and second magnetic modules 130 and 233 respectively included in the first and second cleaning units 100 and 200.

On the other hand, the magnetic force controller 310 can control the magnetic force of the magnetic module 130 in order that the magnetic force that is sensed satisfies previously set value.

For example, as the magnetic force between the first and second magnetic modules 130 and 233 increases, the window cleaning apparatus can be attached more stably, but the window cleaning apparatus becomes harder in moving since the frictional force between the window and the first and second cleaning units 100 and 200 increases.

On the contrary, as the magnetic force between the first and second magnetic modules 130 and 233 decreases, the window cleaning apparatus becomes easy in moving, but the window cleaning apparatus may fall from a window.

Therefore, the previously set value of the magnetic force may be set considering the stability and mobility of the window cleaning apparatus as described above. In detail, the previously set value may be set in a range of a maximum value that allows the window cleaning apparatus to easily move and a minimum value that allows the window cleaning apparatus to stably attached to a window.

Therefore, the magnetic force controller 310 may adjust the magnetic force between the first and second magnetic modules 130 and 233 to be in the previously set value, when the magnetic force and the physical tension between the first and second cleaning units 100 and 200, which is sensed by the magnetic force sensing part 300, is out of the previously set value range.

Figure 5A:
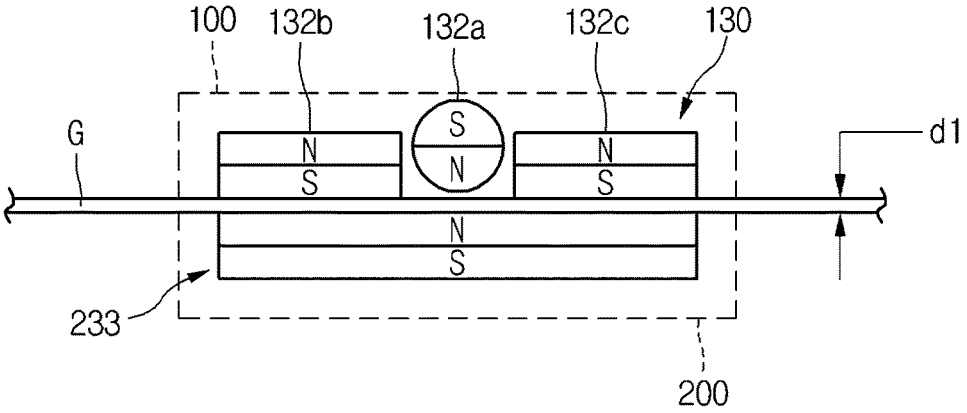
FIGS. 5A and 5B illustrate a structure of magnetic modules according to an embodiment of the present invention.
Figure 5B:
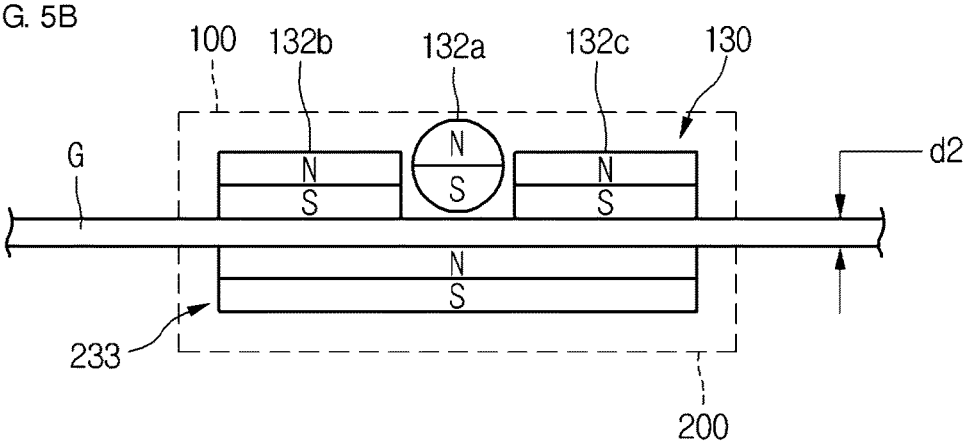

FIGS. 5A and 5B illustrate cross-sectional views for explaining an embodiment regarding method of adjusting magnetic force, and briefly showing the structure of the first and second cleaning units 100 and 200 with the magnetic modules 130 and 233 as the central figure.

Referring to FIGS. 5A and 5B, a thickness of a window G that is to be cleaned by the window cleaning apparatus according to an embodiment of the present invention may be different. For example, according to a building, position or required function of the window G, the window G with various thickness d may be installed.

On the other hand, if the magnetic force of the first and second magnetic modules 130 and 233 respectively installed in the first and second cleaning units 100 and 200 is supposed to be constant, the magnetic force between the first and second magnetic modules 130 and 233 may be variable according to the thickness d of the window G.

That is, as the thickness d of the window G decreases the magnetic force between the first and second magnetic modules 130 and 233 increases. On the contrary, as the thickness d of the window G increases the magnetic force between the first and second magnetic modules 130 and 233 decreases.

For example, the thickness d1 of the window G in FIG. 5A is thinner than the thickness d2 of the window G in FIG. 5B, so that the magnetic force between the first and second magnetic modules 130 and 233 in FIG. 5A is stronger in comparison with that in FIG. 5B.

As described above, when the magnetic force between the first and second magnetic modules 130 and 233 increases, the movement of the window cleaning apparatus becomes harder. Therefore, the magnetic force between the first and second magnetic modules 130 and 233 may be required to be reduced in case of FIG. 5A.

In order to adjust the magnetic force between first and second magnetic modules 130 and 233, the first magnetic module 130 in the first cleaning unit includes first to third magnets 132*a*, 132*b* and 132*c*. The first magnet 132*a* disposed at a center is configured to be rotated by a motor so that the magnetic force between the first and second magnetic modules 130 and 233 may be adjusted by rotation of the first magnet 132*a*.

On the other hand, when the magnetic force between the first and second magnetic modules 130 and 233 decreases, the window cleaning apparatus may not be stably attached to a window. Therefore, the magnetic force between the first and second magnetic modules 130 and 233 may be required to be increased in case of FIG. 5B.

Therefore, according to an embodiment of the present invention, the magnetic force between the first and second cleaning units 100 and 200 may be changed according to the thickness d of the window G. Therefore, the magnetic force controller 310 can adjust the magnetic force between the first and second magnetic modules 130 and 233 so that the magnetic force sensed by the magnetic force sensing part 300 is within the previously set value range.

Hereinbefore, the method of adjusting the magnetic force between the first and second magnetic modules 130 and 233 is performed by controlling the first magnetic module 130 in the first cleaning unit 100 in the above embodiment, but the method of adjusting the magnetic force is not limited to that.

That is, the magnetic force controller 310 may control the second magnetic module 130 in the second cleaning unit 200 in accordance with the magnetic force sensed by the magnetic force sensing part 300. Further, the magnetic force controller 310 may control both of the first and second magnetic modules 130 and 233 such that the magnetic force between the first and second magnetic modules 130 and 233 is within the previous set value range.

As described above, moving stably and easily, a window cleaning robot according to an embodiment of the present invention can clean windows G with various thicknesses d by adjusting the magnetic force between the first and second magnetic modules 130 and 233 to be within the previous set value range.

On the other hand, for example, the case in which the magnetic force between the first and second magnetic modules 130 and 233 is changed according to the thickness d of the window G is explained. However, the magnetic force between the first and second magnetic modules 130 and 233 may be changed according to other factors such as a power supply condition, a window G surface condition, cleaning step, or atmosphere condition, etc.

For example, as shown in FIG. 5A, when the magnetic force between the first and second magnetic modules 130 and 233 is required to be reduced since the thickness of the window G is thin (d1<d2), the first magnet 132*a* of the first magnetic module is rotated such that the pole of the first magnet 132*a* is opposite to a pole of the second magnetic module 233. In this case, poles of the second magnet 132*b* and the third magnet 132*c* are opposite to the pole of the second magnetic module 233 facing the second magnet 132*b* and the third magnet 132*c* to pull each other, but the first magnet 132*a* faces the second magnetic module 233 with the same poles to push each other.

Therefore, the attractive force between the second and third magnets 132*b* and 132*c* and the second magnetic module 233 is reduced by the repulsive force between the first magnet 132*a* and the second magnetic module 233, so that the attractive force between the first magnetic module 130 and the second magnetic module 233 in total may become smaller than that in FIG. 5B.

On the contrary, when strong attractive force is required between the first and second magnetic modules 130 and 233 since the window is thick, the first magnet 132*a* is rotated such that the pole of the first magnet 132*a* is opposite to the pole of the second magnetic module 233 to enforce attractive force.

And, the magnetic force between the first and second magnetic modules 130 and 233 may be adjusted by rotation amount (rotation angle) of the first magnet 132. In order for that, the magnetic force controller 310 may keep information of the magnetic force between the first and second magnetic modules in accordance with the rotation angle of the first magnet 132*a*, and control the rotation angle of the first magnet 132*a* according to required magnetic force.

As described referring to FIG. 1 through FIG. 5B, there may exist a gap between the first and second cleaning units 100 and 200, when the second cleaning unit 200 moves following the first cleaning unit 100 through magnetic force between the first and second magnetic modules 130 and 233 installed at the first and second cleaning units 100 and 200, respectively, as the first wheel member 120 installed at the first cleaning unit 100 rotates by a wheel driving part 121 including a motor.

For example, when the second cleaning unit 100 cannot follow since the first cleaning unit 100 moves too fast, or when the second cleaning unit 100 cannot move due to an obstacle on a surface of a window, there may exist a gap between positions of the first and second cleaning units 100 and 200 so that the magnetic force between the first and second cleaning units 100 and 200 may become weak.

Figure 6A:
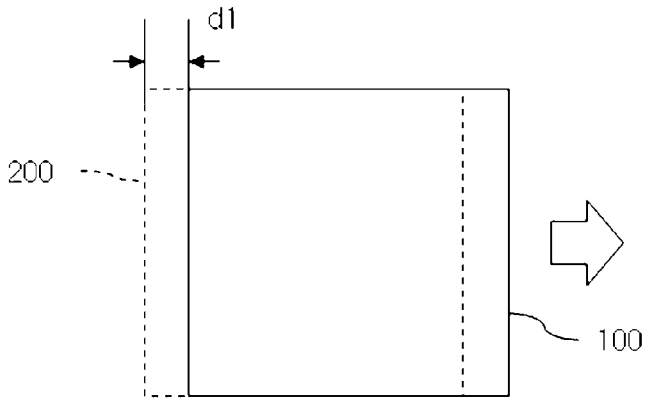
FIGS. 6A and 6B illustrate examples of cases in which there exists a gap between the first and second cleaning units, when a window cleaning apparatus moves.
Figure 6B:
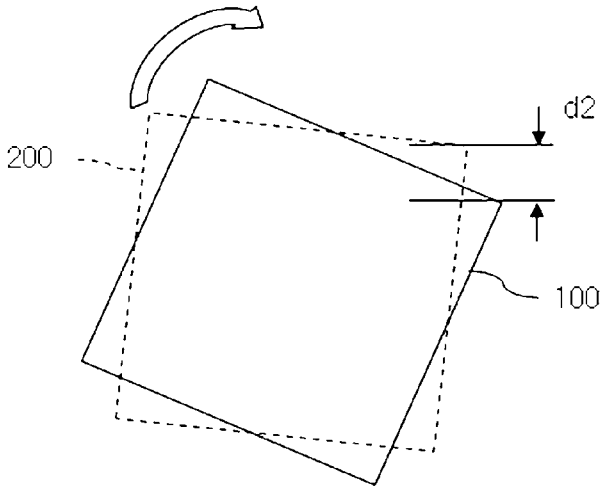

FIGS. 6A and 6B illustrate examples of cases in which there exists a gap between the first and second cleaning units, when a window cleaning apparatus moves.

Referring to FIG. 6A, during the first cleaning unit 100 moves in a right direction, the second cleaning unit 200 cannot follow the first cleaning unit 100 due to various reasons so that there may exist a gap d1 between positions of the first and second cleaning units 100 and 200.

Referring to FIG. 6B, during the first cleaning unit 100 rotates in a clockwise direction, the second cleaning unit 200 cannot follow the first cleaning unit 100 due to various reasons so that there may exist a gap d2 between positions of the first and second cleaning units 100 and 200.

On the other hand, when the magnetic force between the first and second cleaning units 100 and 200 becomes lower than a specific value due to the above reasons, the first and second cleaning units 100 and 200 cannot attached to a window. Especially, the second cleaning unit 200 attached to an outer surface of the window may fall down to damage a person or a stuff seriously.

According to an embodiment of the present invention, when the magnetic force between the first and second cleaning units 100 and 200 is out of a normal range, at least one of positions of the first and second cleaning units 100 and 200 is adjusted so that the magnetic force between the first and second cleaning units 100 and 200 may return to the normal range in order to prevent the window cleaning apparatus from falling down.

Figure 7:
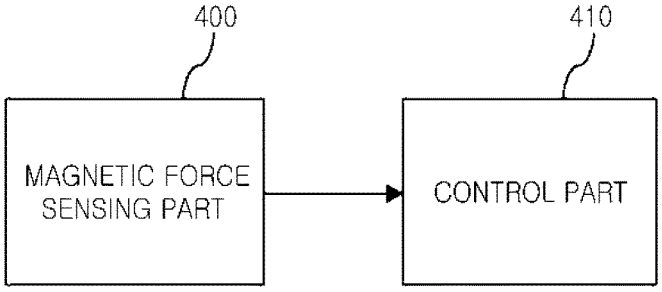
FIG. 7 is a block diagram showing a window cleaning apparatus according to an embodiment of the present invention.

FIG. 7 is a block diagram showing a window cleaning apparatus according to an embodiment of the present invention. The window cleaning apparatus may include a magnetic force sensing part 400 and a control part 410.

Referring to FIG. 7, the magnetic force sensing part 400 can detect if the magnetic fields between the first and second cleaning units 100 and 200 is within the normal range.

For example, the magnetic force sensing part 400 may include a magnetic sensor for sensing the magnetic force between the first and second cleaning units 100 and 200, or analyze the magnetic force between the first and second cleaning units 100 and 200 through a value measured by using one or more than one sensors or a specific event.

On the other hand, the control part 410 can move or rotate one of the first and second cleaning units 100 and 200 to adjust a position of the cleaning unit, when the magnetic force between the first and second cleaning units 100 and 200 is out of the normal range.

As an embodiment of the present invention, the magnetic force sensing part 400 and the control part 410 in FIG. 7 may be installed at the first cleaning unit 100 being attached to an inner surface of a window and performing a movement of the window cleaning apparatus.

In this case, the control part 410 installed at the first cleaning unit 100 moves or rotates the first cleaning unit 100 in a specific direction to control to coincide posture of the first and second cleaning units 100 and 200 such that the magnetic force between the first and second cleaning units 100 and 200 returns to the normal range, when the magnetic force sensed by the magnetic force sensing part 400 becomes weaker than a reference value since there exists a position gap between the first and second cleaning units 100 and 200, which is greater than a specific value.

Hereinafter, a method of controlling a window cleaning apparatus according to the present invention will be explained in detail, referring to FIG. 8 through FIG. 13B.

Figure 8:
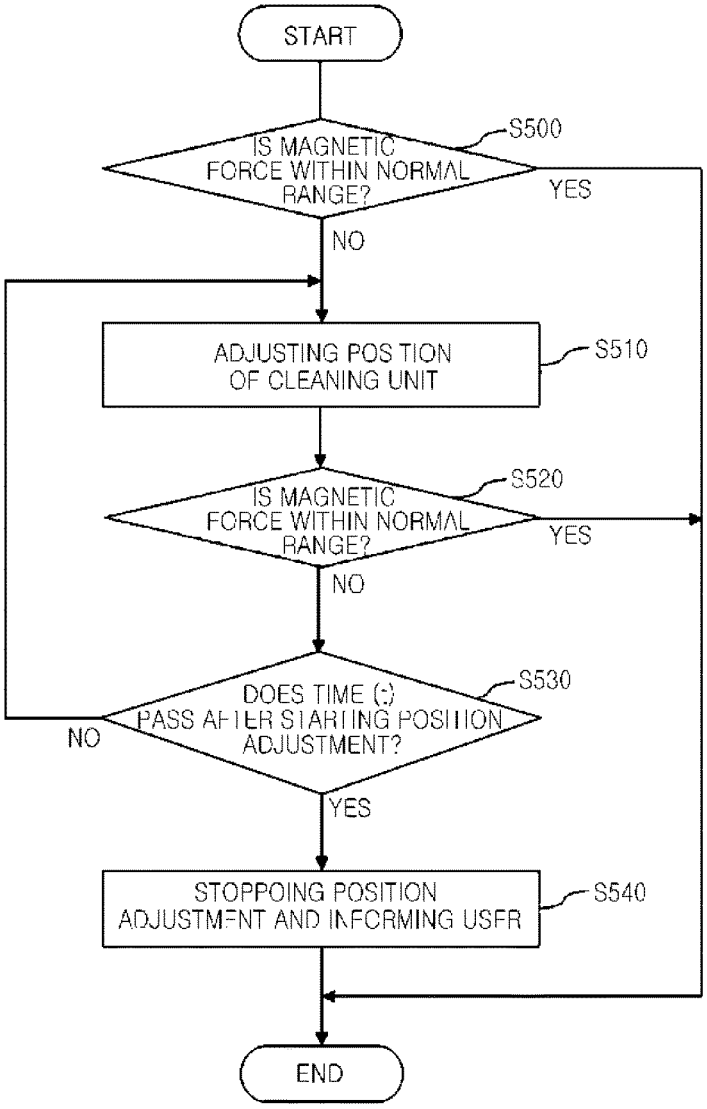
FIG. 8 is a flow chart showing a method of controlling a window cleaning apparatus according to an embodiment of the present invention.

FIG. 8 is a flow chart showing a method of controlling a window cleaning apparatus according to an embodiment of the present invention, and the method will be explained in association with the block diagram in FIG. 7.

Referring to FIG. 8, the magnetic force sensing part 400 detects if the magnetic force between the first and second cleaning units 100 and 200 is in a normal range (step S500).

For example, the magnetic force sensing part 400 measures the magnetic force between the first and second cleaning units 100 and 200, and decides that the magnetic force becomes reduced since the gap between the first and second cleaning units 100 and 200 becomes greater than a specific value when the measured magnetic force is smaller than a specific value that is previously set.

As another embodiment of the present invention, by using no less than one light generating section and no less than on light receiving section installed at the first and second cleaning units 100 and 200, respectively, it is decided that the gap between the first and second cleaning units 100 and 200 becomes greater than a specific value when a light generated by the light generating section is not received by the light receiving section.

Figure 9A:
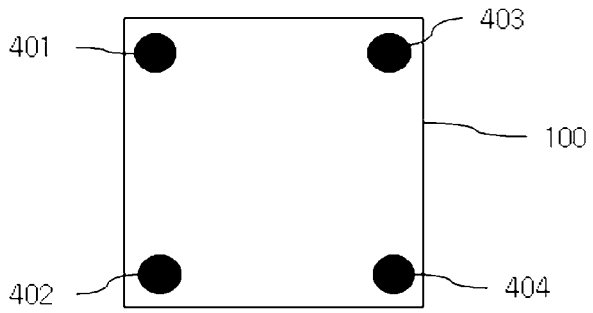
FIGS. 9A and 9B illustrate an example of a structure for sensing magnetic field between the first and second cleaning units.
Figure 9B:
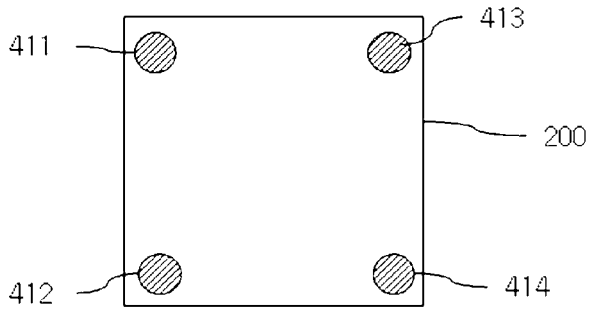

For example, as shown in FIG. 9A, the light receiving sections 401 through 404 may be installed at corners of the first cleaning unit 100, and the light generating sections 411 through 414 may be installed at corners of the second cleaning unit 200.

When the positions of the first and second cleaning units 100 and 200 are coincide within a specific range, a light generated by the light generating sections 411 through 414 of the second cleaning unit 200 may be received by the light receiving sections 401 through 404 of the first cleaning unit 100 to be sensed.

On the other hand, when the positions of the first and second cleaning units 100 and 200 are off out of the specific range, a light generated by the light generating sections 411 through 414 of the second cleaning unit 200 may not be received by the light receiving sections 401 through 404 of the first cleaning unit 100 not to be sensed.

Therefore, when a light generated by the light generating sections 411 through 414 of the second cleaning unit 200 may not be received by the light receiving sections 401 through 404 of the first cleaning unit 100, it may be decided that the positional gap between the first and second cleaning units 100 and 200 is greater than the specific value to decrease the magnetic force.

Figure 10:
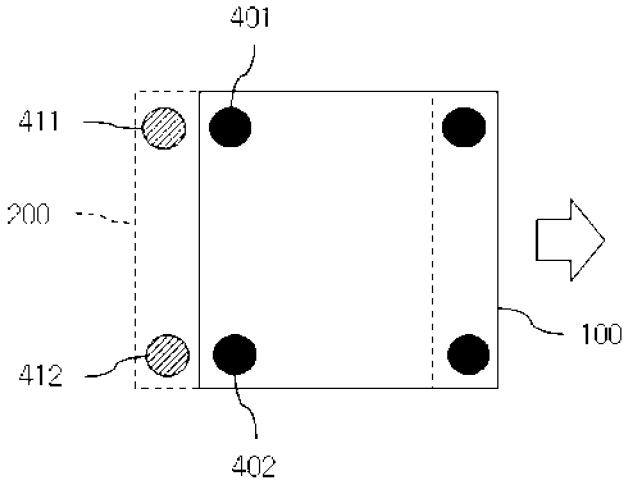
FIG. 10 and FIG. 11 are figures showing examples of methods of detecting that the magnetic fields between the first and second cleaning units becomes weak.

Referring to FIG. 10, when the first cleaning unit 100 moves faster than the second cleaning unit 200 in a right direction, a light generated by the light generating sections 411 through 414 of the second cleaning unit 200 may not be received by the light receiving sections 401 through 401 of the first cleaning unit 100, so that it may be decided that the positional gap between the first and second cleaning units 100 and 200 is greater than the specific value to decrease the magnetic force.

Figure 11:
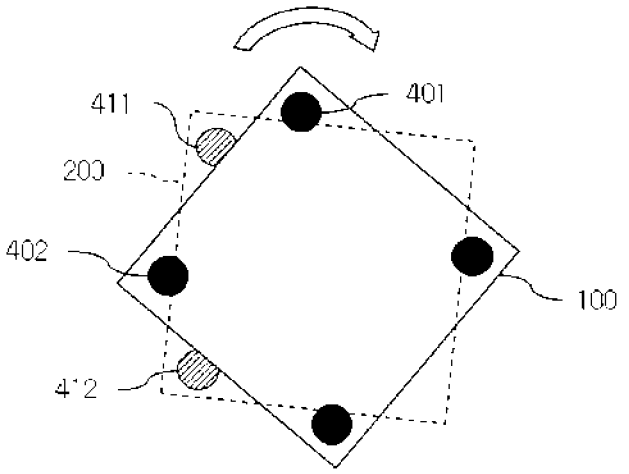

Referring to FIG. 11, when the first cleaning unit 100 rotates faster than the second cleaning unit 200 in a clockwise direction, a light generated by the light generating sections 411 through 414 of the second cleaning unit 200 may not be received by the light receiving sections 401 through 401 of the first cleaning unit 100, so that it may be decided that the positional gap between the first and second cleaning units 100 and 200 is greater than the specific value to decrease the magnetic force.

On the other hand, the structure in FIG. 9A through FIG. 11 is only an embodiment, and the present invention is not limited to this. For example, the position and the number of the light generating sections 411 through 414 and the light receiving sections 401 through 404 may be changed as required.

As described above, when the magnetic force is out of the normal range, the control part 410 adjusts the position of the cleaning unit (step S510).

In the step S510, the control part 410 can adjust the position of the cleaning unit by moving at least one of the first and second cleaning units, for example the first cleaning unit 100 in a direction opposite to a previous moving direction.

Figure 12A:
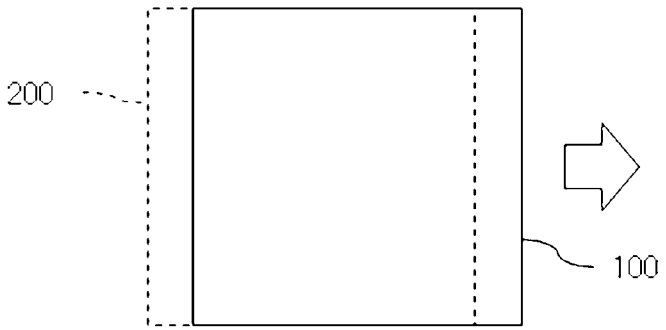
FIGS. 12A and 12B illustrate decrease of the magnetic field as the gap between the first and second cleaning units becomes larger than the specific value while the first cleaning module moves in a right direction.
Figure 12B:
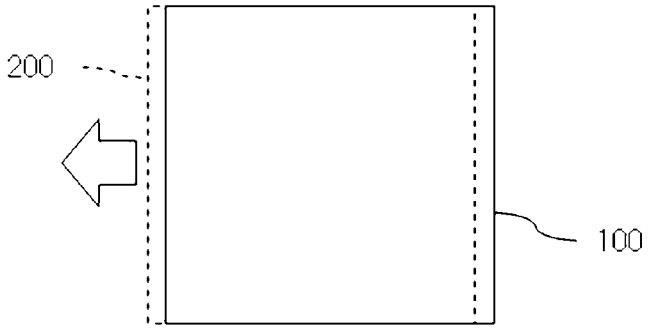

Referring to FIGS. 12A and 12B, when the magnetic field decreases since the gap between the first and second cleaning units 100 and 200 becomes larger than the specific value during the first cleaning module 100 moves in a right direction, the control part 410 may move the first cleaning unit 100 in a left direction that is opposite to the moving direction of the first cleaning unit 100 to adjust position.

On the other hand, when the magnetic field becomes within a normal range since the gap between the first and second cleaning units 100 and 200 becomes smaller than the specific value as the first cleaning unit 100 is moved in the left direction by the control part 410, the first and second cleaning units 100 and 200 move in the previous moving direction to continue cleaning.

Further, the control part 410 may be rotated in a direction that is opposite to the previous rotating direction to adjust position of the cleaning unit.

Figure 13A:
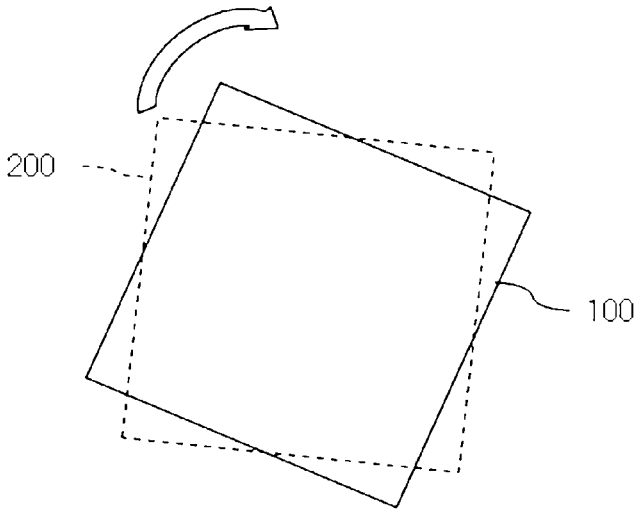
FIGS. 13A and 13B illustrate decrease of the magnetic field as the gap between the first and second cleaning units becomes larger than the specific value while the first cleaning module rotates in a clockwise direction.
Figure 13B:
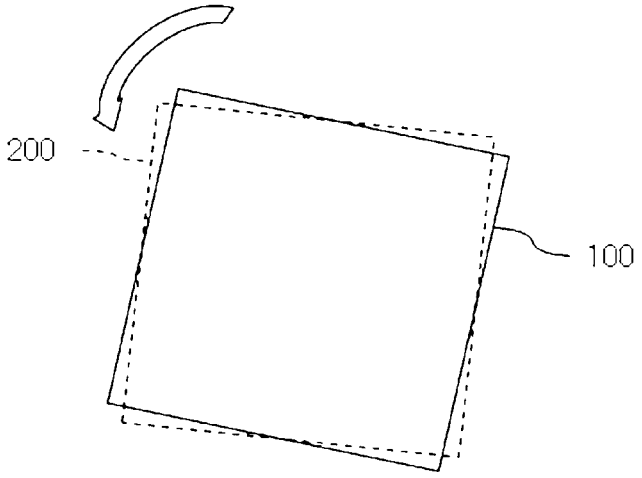

Referring to FIGS. 13A and 13B, when the magnetic field decreases since the gap between the first and second cleaning units 100 and 200 becomes larger than the specific value while the first cleaning module 100 rotates in a clockwise direction, the control part 410 may rotate the first cleaning module 100 in a counterclockwise direction that is opposite to the rotating direction of the first cleaning unit 100 to adjust position.

On the other hand, when the magnetic field becomes within a normal range since the gap between the first and second cleaning units 100 and 200 becomes smaller than the specific value as the first cleaning unit 100 is rotated in the counterclockwise direction by the control part 410, the first and second cleaning units 100 and 200 rotate in the previous moving direction to continue cleaning.

When the magnetic field between the first and second cleaning units 100 and 200 is not in the normal range even through a specific time passes after starting moving or rotating in the step S510, at least one of the first and second cleaning units 100 and 200 is stopped to output a user alarm.

That is, after (or during) adjusting the position in the step S510, the magnetic force sensing part 400 periodically detects if the magnetic force between the first and second cleaning units 100 and 200 is within the normal range (step S520), and it is checked if position adjusting time (t), which is previously set, passes when the magnetic field is out of the normal range (step S530).

When the position adjusting time (t) does not pass, the control part 410 may repeat the step S510 and the step S520 until the magnetic field between the first and second cleaning units 100 and 200 becomes within the normal range.

However, when the position adjusting time (t) passes, the control part 4100 stops adjusting and output the user alarm (step S540).

For example, in case of FIGS. 12A and 12B, when the magnetic field between the first and second cleaning units 100 and 200 is not within the normal range even though the control part 410 moves the first cleaning unit 100 in the left direction to adjust position, the control part 410 stops moving (or rotating) of the first cleaning unit 100 and informs a user that the magnetic force is abnormal through an ocular effect such as a lamp or an auditory effect such as a buzzer sound.

According to another embodiment, together with (or apart from) the method of controlling the window cleaning apparatus as described referring to FIG. 6A through FIG. 13B, the moving or the rotating of the first cleaning unit 100 may be stopped and a user may be informed through an ocular effect such as a lamp or an auditory effect such as a buzzer sound when the attachment/detachment member 150 is not in a close state.

The method of controlling the window cleaning apparatus may be embodied as a program and may be stored in a computer readable storage medium such as ROM, RAM, CD-ROM, magnetic tape, floppy disc, optical data storage device, etc. Further, the method of controlling the window cleaning apparatus may be embodied as a format of carrier wave (for example, transmission through internet).

The computer readable storage medium may be distributed in a computer system connected by network, and codes that are readable by a computer in a distribution type may be stored and performed. And, functional program, code and code segments for embodying the control method may be easily formed by a programmer ordinary skilled in the art.

In the specifications, the present invention is explained referring to the preferred embodiments, but the embodiments are only examples and the present invention is not limited to that. The present invention may be variously modified and applied. For example, each elements in the embodiment may be modified, and the modification of claimed invention should be included in the present invention.

INDUSTRIAL APPLICABILITY

The present invention may be applicable to a industries relating with window cleaning and movable robot.

What is claimed is:

1. A window cleaning apparatus with a first cleaning unit and a second cleaning unit attached on opposite surfaces of a window, respectively, through a magnetic field, and moving or rotating in a first direction on the opposite surfaces of the window, the window cleaning apparatus comprising:

a first magnetic module included in the first cleaning unit;

a second magnetic module included in the second cleaning unit;

a control part moving or rotating at least one of the first and second cleaning units in a second direction opposite to the first direction when the magnetic field between the first and second cleaning units is out of a normal range; and a magnetic sensor configured to sense the magnetic force between the first and second cleaning units, wherein, if the sensed magnetic force is weaker than a reference value by a moving or rotating one of the first and second cleaning units in a first moving or rotating direction, the control part is configured to move or rotate at least one of the first and second cleaning units in a second moving or rotating direction that is opposite to the first moving or rotating direction, wherein the first and second moving or rotating direction is parallel to the surface of a window.

2. The window cleaning apparatus of claim 1, wherein the control part moves or rotates the at least one of the first and second cleaning units in the second direction when a gap between the first and second cleaning units becomes equal to or greater than a specific value.

3. The window cleaning apparatus of claim 1, wherein one of the first and second cleaning units comprises a light generating section, and the other one of the first and second cleaning units comprises a light receiving section, and wherein the control part moves or rotates the at least one of the first and second cleaning units in the second direction when a light generated by the light generating section is not received by the light receiving section.

4. The window cleaning apparatus of claim 1, wherein the control part stops the at least one of the first and second cleaning units and controls to output a user alarm when the magnetic field between the first and second cleaning units is not within the normal range even though a specific time has passed after starting the moving or rotating in the second direction.

* * * * *